US006656102B1

(12) United States Patent
Nagano

(10) Patent No.: US 6,656,102 B1
(45) Date of Patent: Dec. 2, 2003

(54) PARALLEL FOLDING DEVICE OF FOLDING MACHINE

(75) Inventor: Hiroyuki Nagano, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/762,819

(22) PCT Filed: Mar. 16, 2000

(86) PCT No.: PCT/JP00/01597

§ 371 (c)(1),
(2), (4) Date: Feb. 13, 2001

(87) PCT Pub. No.: WO01/68496

PCT Pub. Date: Sep. 20, 2001

(51) Int. Cl.[7] ..... B31F 1/10

(52) U.S. Cl. ..... 493/423; 493/424; 493/425; 493/434; 493/454

(58) Field of Search ..... 493/423, 424, 493/425, 426, 427, 434, 454

(56) References Cited

U.S. PATENT DOCUMENTS 4,738,440 A * 4/1988 Weir ..... 270/45
5,030,193 A * 7/1991 Breton et al. ..... 493/357
5,211,621 A * 5/1993 Cheynet ..... 493/413
5,405,126 A * 4/1995 Mack ..... 270/21.1
5,425,697 A * 6/1995 Lanvin ..... 493/426
6,010,122 A * 1/2000 Weber ..... 270/32

FOREIGN PATENT DOCUMENTS

| | | |
|---|---|---|
| JP | Y2-2535158 | 2/1997 |
| JP | Y2-2550776 | 6/1997 |
| JP | A11130343 | 5/1999 |

* cited by examiner

*Primary Examiner*—Rinaldi I. Rada
*Assistant Examiner*—Gloria R Weeks
(74) *Attorney, Agent, or Firm*—Birch, Stewart, Kolasch & Birch, LLP

(57) ABSTRACT

The folding device of a folding machine, which can perform parallel double folding and delta folding, and which can smoothly and reliably transfer a parallel single-folded signature between first and second jaw cylinders regardless of paper quality. A first jaw cylinder and a second jaw cylinder arranged with circumferential surfaces thereof opposed to and in contact with each other. At least one belt is looped between the first jaw cylinder and a set of rollers, and wherein one of the rollers is moved to switch the belt between a guide position and a retreat position.

11 Claims, 5 Drawing Sheets

PARALLEL FOLDING DEVICE OF FOLDING MACHINE

TECHNICAL FIELD

This invention relates, particularly, to a parallel folding device of a folding machine, in which a parallel single-folded signature can be smoothly transferred between first and second jaw cylinders.

BACKGROUND ART

A web rotary press is equipped with a folding machine for cutting a web, which has been dried and cooled after printing, at intervals of a predetermined length, or for folding the web widthwise or lengthwise.

The folding machine has various structures. Among them, for example, there is one having a parallel folding device as shown in FIGS. 3 and 4(*a*) and 4(*b*), (see Japanese Utility Model Publication No. 43097/95).

This folding machine has a cut-off cylinder 1, a folding cylinder 2, a first jaw cylinder 3, and a second jaw cylinder 4 which are opposed to each other in contact and rotate in the directions of arrows in the drawing. A web 8, fed by a nipping roller 5, a cross perforation cylinder 6, and a nipping roller 7 in this order, is cut to predetermined dimensions with a cut-off knife (not shown) of the cut-off cylinder 1 to form a signature 9. This signature 9 is parallel folded between a single-folding knife (not shown) of the folding cylinder 2 and a gripper board 10 and a folding jaw 11 of the first jaw cylinder 3. In the case of parallel single folding, the signature 9, as single folded, is transported toward a chopper 14 by a gripper 12 and a gripper pad 13 of the second jaw cylinder 4 (see FIG. 4(*a*)). In the case of parallel double folding or delta folding, the signature is further parallel folded between a double-folding knife (not shown) of the first jaw cylinder 3 and a gripper board 15 and a folding jaw 16 of the second jaw cylinder 4. As a result, the signature is parallel double folded, and transported toward the chopper 14 (see FIG. 4(*b*)).

In the drawings, the numerals 17*a* to 17*c* denote signature transporting/holding brushes for transfer of the signature 9 between the first jaw cylinder 3 and the second jaw cylinder 4.

The foregoing parallel folding device faces the following problems: When the signature 9, parallel folded once, is transferred from the first jaw cylinder 3 to the second jaw cylinder 4, the front end of the signature bent by a gripping margin of the signature, which has been gripped by the gripper board 10 and the folding jaw 11 of the first jaw cylinder 3 as shown in FIG. 3, is raised by the gripper 12 of the second jaw cylinder 4 and then gripped. If the paper quality of the web is such that the front end of the signature has inherent characteristics, therefore, breakage and curling of the front end of the signature, curling of the entire signature, and mistiming occur, making stable transfer of the signature impossible. During chopper folding at a subsequent step, moreover, such problematical signature 9 exerts adverse influence, deteriorating the accuracy of chopper folding.

Furthermore, the parallel folding device is configured to be able to perform parallel double folding and delta folding, as shown in FIG. 4(*b*). Thus, when the parallel single-folded signature 9 is transferred as shown in FIG. 4(*a*), the phenomenon that the signature 9 is carried away toward the first jaw cylinder 3 because of the presence of a space A takes place. As a result, a folding trouble as shown in FIGS. 5(*a*) to 5(*c*) occurs, such as a middle fold (the case of FIG. 5(*a*)), a corner fold (the case of FIG. 5(*b*)), or cuts in the trailing edge of the sheet (the case of FIG. 5(*c*)).

The present invention has been accomplished to solve the above-mentioned problems. The object of the invention is to provide a parallel folding device of a folding machine, which can perform parallel double folding and delta folding, and which can smoothly and reliably transfer a parallel single-folded signature between first and second jaw cylinders regardless of paper quality.

DISCLOSURE OF THE INVENTION

To attain the above object, in a parallel folding device of a folding machine, comprising a first jaw cylinder and a second jaw cylinder arranged with circumferential surfaces thereof opposed to and in contact with each other, a belt is passed over a part of the circumferential surface of the first jaw cylinder, and the belt can be switched between a guide position at which the belt guides a front end of a signature from the first jaw cylinder to the second jaw cylinder during gripping change from the first jaw cylinder to the second jaw cylinder, and a retreat position to which the belt retreats from the second jaw cylinder when the signature is folded by the first jaw cylinder and the second jaw cylinder.

According to this feature, parallel double folding and delta folding are possible because of the presence of the second jaw cylinder. Moreover, a parallel single-folded signature can be transferred smoothly and reliably between the first and second jaw cylinders under guidance by the belt regardless of paper quality.

Inwardly of right and left frames, as a pair, of the folding machine, a plurality of rollers are provided transversely below the first jaw cylinder rotatably and parallel to the first jaw cylinder, and the belt is looped between these rollers and the first jaw cylinder.

Thus, stable belt engagement is possible.

A plurality of the belts are provided so as to run along the circumferential surface of the first jaw cylinder in a region in which the first jaw cylinder transports the signature, and each of the belts travels in accordance with the rotation of the first jaw cylinder by a frictional force working between each of the belts and the circumferential surface of the first jaw cylinder.

Thus, drag of each belt is performed smoothly and reliably.

A plurality of annular grooves are provided on the circumferential surface of the first jaw cylinder so as to be out of phase with a gripper board and a folding jaw in a cylinder shaft direction, the belts are passed in the annular grooves along the circumferential surface of the first jaw cylinder, and the depth of the annular groove is set such that the outer peripheral surface of the belt and the circumferential surface of the cylinder form the same peripheral surface.

Thus, occurrence of concave and convex flaws by the belt is avoided, and the quality maintenance of the signature is achieved.

The roller closest to the second jaw cylinder is adapted to be movable toward and away from the second jaw cylinder via bearing members for supporting both shaft ends of the roller, whereby the belt can be switched between the guide position and the retreat position.

Thus, scratches of the belt under varying tension are avoided, and the quality maintenance of the signature is achieved.

BRIEF DESCRIPTION OF THE DRAWINGS

FIG. 1(*b*) is a partial sectional view of a first jaw cylinder depicting annular grooves in the first jaw cylinder.

BEST MODE FOR CARRYING OUT THE INVENTION

A parallel folding device of a folding machine according to the present invention will now be described in detail by way of an Example using the accompanying drawings.

EXAMPLE

Figure 1A:
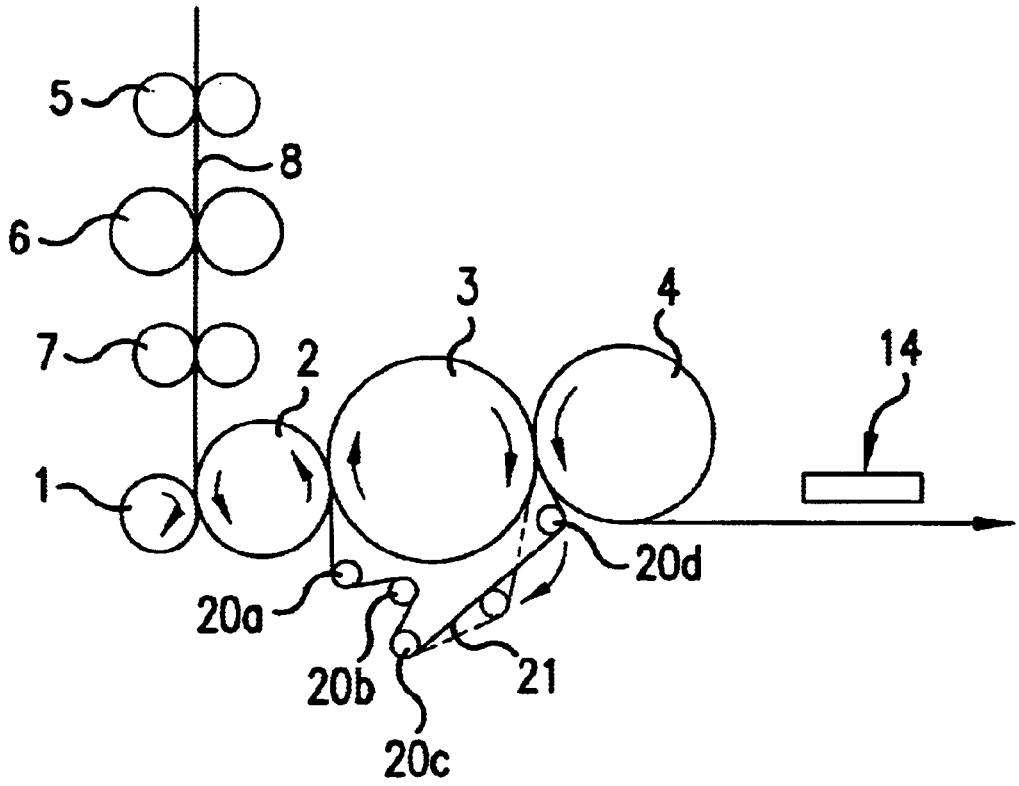
FIG. 1(*a*) is a side view of a parallel folding device of a folding machine showing an embodiment of the present invention.
Figure 1B:
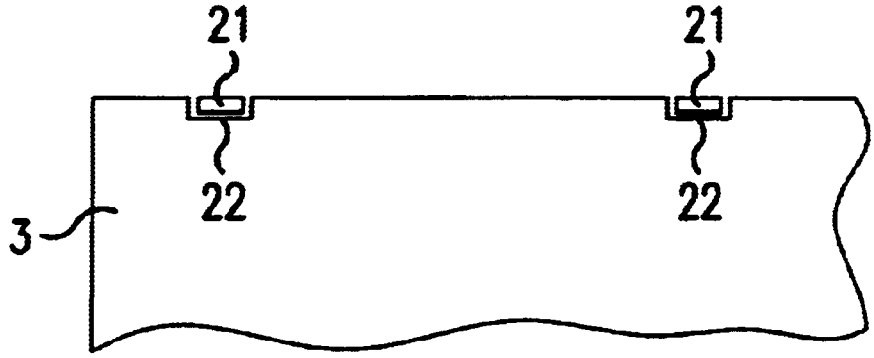
Figure 2A:
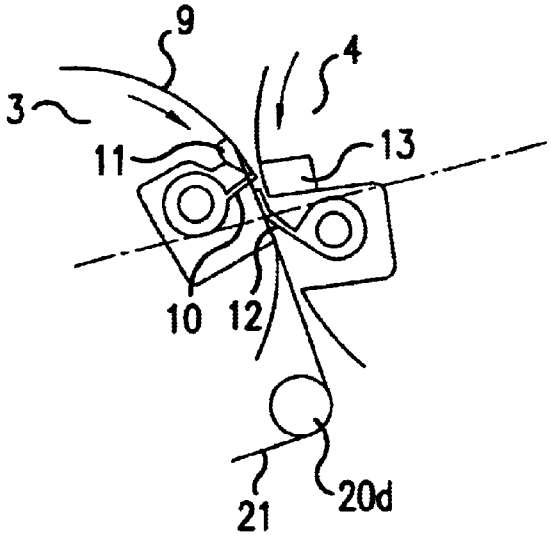
FIGS. 2(*a*) to 2(*d*) are explanation drawings of a transfer action between first and second jaw cylinders of the parallel folding device.
Figure 2B:
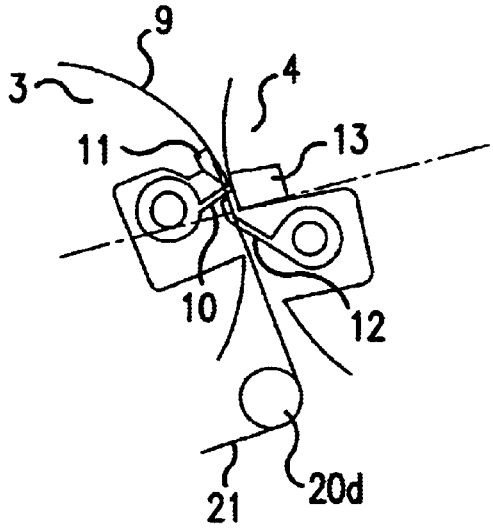
Figure 2C:
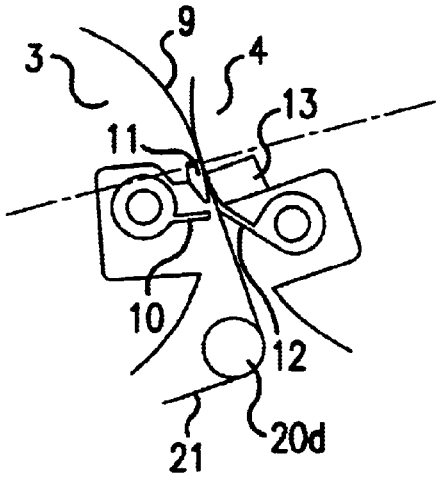
Figure 2D:
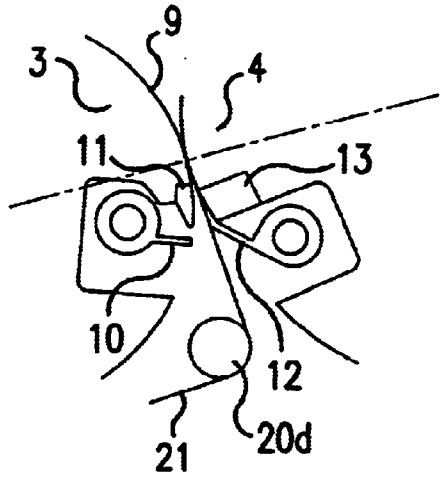
Figure 3:
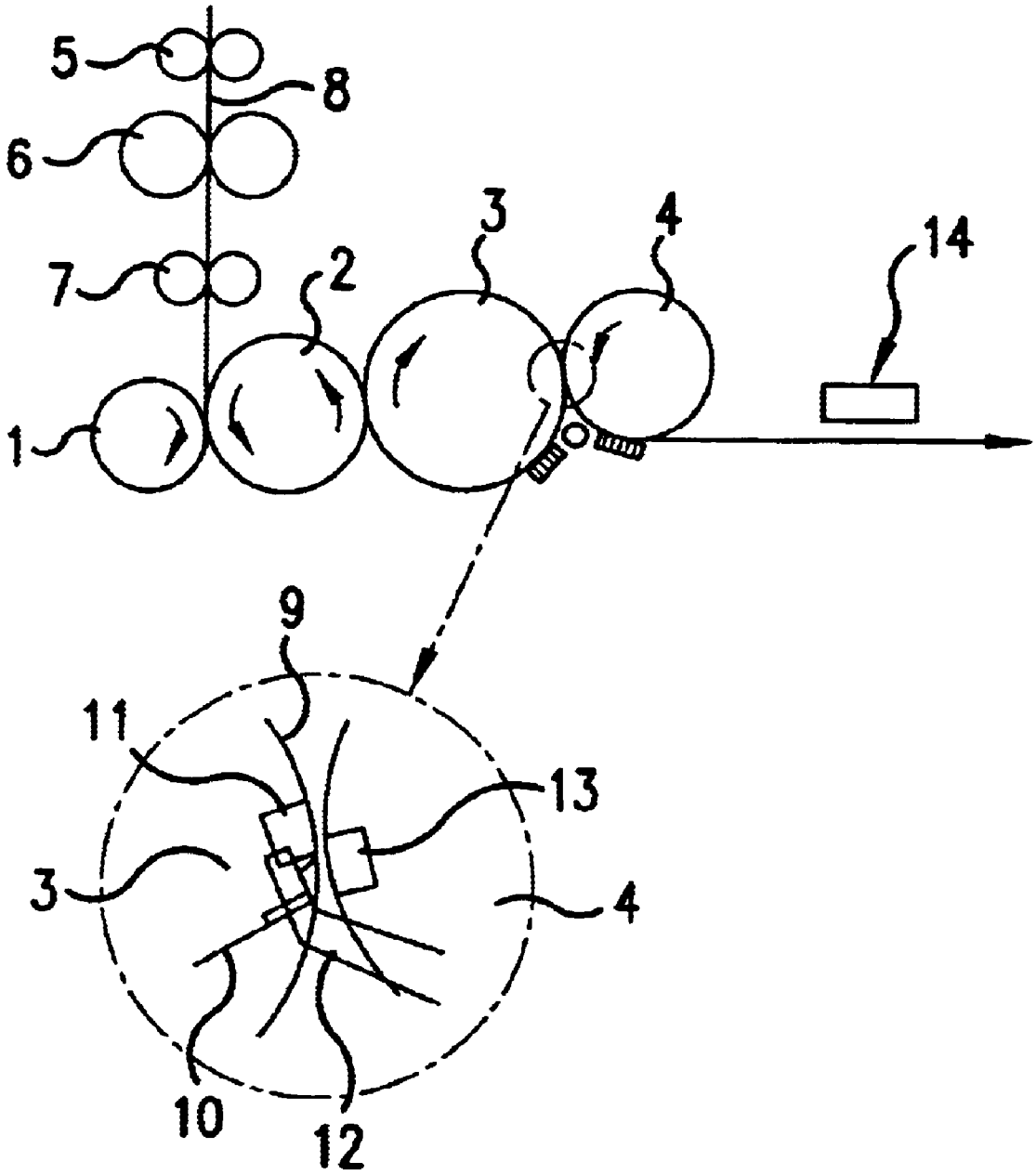
Fig.3 RELATED ART
FIG. 3 is a side view of a parallel folding device of a folding machine according to a conventional example.

FIG. 1(*a*) is a side view of a parallel folding device of a folding machine showing an embodiment of the present invention. FIG. 1(*b*), FIGS. 2(*a*) to 2(*d*) are explanation drawings of a transfer action between first and second jaw cylinders of the parallel folding device. In these drawings, the same members as in FIGS. 3 and 4(*a*) and 4(*b*) are assigned the same numerals, and detailed explanations are omitted.

As illustrated, a web 8 fed by the route, a nipping roller 5→a cross perforation cylinder 6→a nipping roller 7, is cut to predetermined dimensions with a cut-off knife (not shown) of a cut-off cylinder 1 to form a signature 9. This signature 9 is parallel folded between a single-folding knife (not shown) of a folding cylinder 2 and a gripper board 10 and a folding jaw 11 of a first jaw cylinder 3. In the case of parallel single folding, the signature 9, as single-folded, is transported toward a chopper 14 by a gripper 12 and a gripper pad 13 of a second jaw cylinder 4. In the case of parallel double folding or delta folding, the folded signature is further parallel double-folded between a double-folding knife (not shown) of the first jaw cylinder 3 and a gripper board 15 (see FIG. 4(*b*)) and a folding jaw 16 (see FIG. 4(*b*)) of the second jaw cylinder 4. Then, the double-folded signature is transported toward the chopper 14.

Inwardly of right and left frames, as a pair, of the folding machine, four rollers 20*a* to 20*d* are provided transversely below the first jaw cylinder 3 rotatably and parallel to the first jaw cylinder 3, and a belt 21 is looped between these rollers 20*a* to 20*d* and the first jaw cylinder 3.

A plurality of the belts 21 are provided so as to run along a nearly upper half of the circumference of the first jaw cylinder 3. Each of the belts 21 travels in accordance with the rotation of the first jaw cylinder 3 by a frictional force working between the belt 21 and the circumferential surface of the first jaw cylinder 3.

A plurality of annular grooves 22 shown in FIG. 1(*b*) are provided on the circumferential surface of the first jaw cylinder 3 so as to be out of phase with the gripper board 10 and the folding jaw 11 in a cylinder shaft direction, the belts 21 are passed in the annular grooves 22 along the circumferential surface of the first jaw cylinder, and the depth thereof is set such that the outer peripheral surface of the belt 21 and the circumferential surface of the cylinder form the same peripheral surface.

The roller 20*d* closest to the second jaw cylinder 4 is adapted to be movable toward and away from the second jaw cylinder 4, for example, because bearing members (not shown) for supporting both shaft ends of the roller 20*d* are installed on linear guides. Because of this feature, the belt 21 can be switched, with its tension unchanged, between a guide position (the position indicated by a solid line in FIG. 1) at which the belt 21 guides a front end of the signature from the first jaw cylinder 3 to the second jaw cylinder 4 at the time of gripping change from the first jaw cylinder 3 to the second jaw cylinder 4 during parallel single folding, and a retreat position (the position indicated by a chain line in FIG. 1) to which the belt 21 retreats from the second jaw cylinder 4 at the time of parallel folding by the first jaw cylinder 3 and the second jaw cylinder 4 during parallel double folding or delta folding.

Because of this constitution, the belt 21 is switched to the position of the solid line in FIG. 1 by the movement of the roller 20*d* during parallel single folding.

The timing of transfer of the signature 9 between the first jaw cylinder 3 and the second jaw cylinder 4 during this action will be explained based on FIGS. 2(*a*) to 2(*d*). As shown in FIG. 2(*a*), the signature 9 is transported by the first jaw cylinder 3, with the front end of the signature 9 being pinched between the gripper board 10 and the folding jaw 11.

Then, the gripper board 10 begins to release the front end of the signature 9 with the timing shown in FIG. 2(*b*). Simultaneously with, or somewhat before or after this timing, the belt 21 contacts the front end of the signature 9, raising the gripping margin of the signature 9 (straightening the front end of the signature).

Then, while guiding the front end of the signature, the belt 21 presses the front end of the signature against the second jaw cylinder 4, as shown in FIG. 2(*c*). In the meantime, the front end of the signature is pinched between the gripper 12 and the gripper pad 13 of the second jaw cylinder 4, and the transfer of the signature 9 between the first jaw cylinder 3 and the second jaw cylinder 4 is completed (see FIG. 2(*d*)).

Even after completion of the transfer, the belt 21 presses the signature 9 against the second jaw cylinder 4. During this action, brushes 17a and 17b need not guide the signature 9, and may be moved backward from the illustrated positions by suitable means.

Figure 4A:
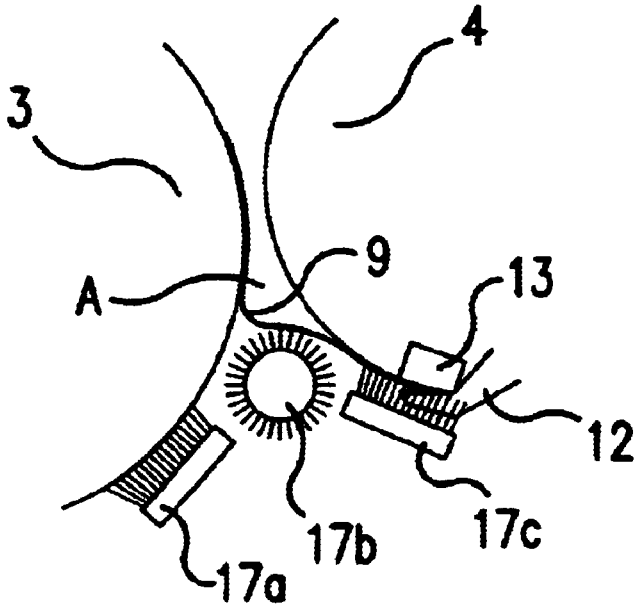
FIGS. 4(*a*) and 4(*b*) are explanation drawings of a transfer action between first and second jaw cylinders of the parallel folding device.
Figure 4B:
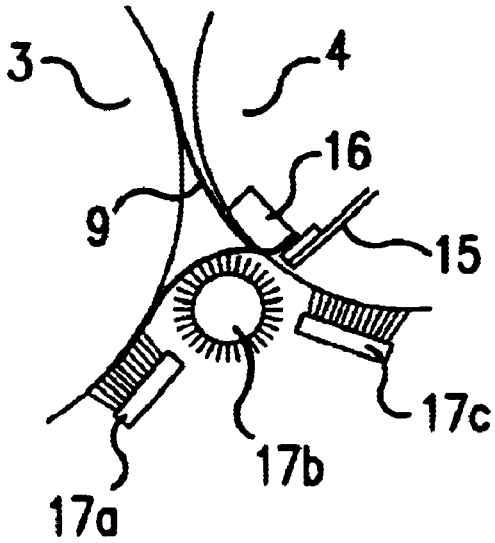
Figure 5A:
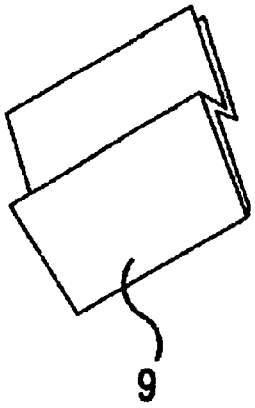
FIGS. 5(*a*) to 5(*c*) are explanation drawings of various folding troubles.
Figure 5B:
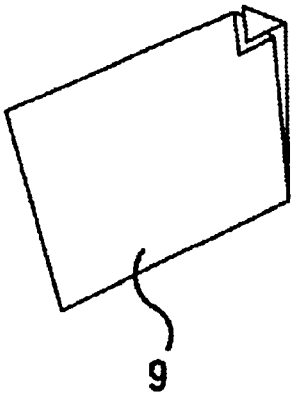
Figure 5C:
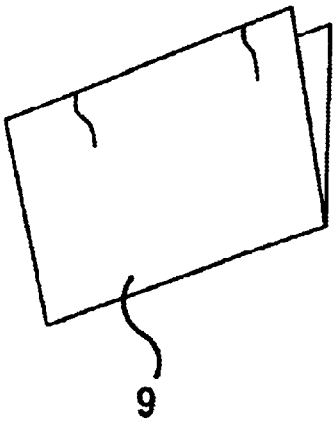

During parallel double folding or delta folding, on the other hand, the belt 21 is switched to the chain line in FIG. 1 by the movement of the roller 20d, so that parallel double folding or delta folding as shown in FIG. 4(*b*) will be performed between the first jaw cylinder 3 and the second jaw cylinder 4.

According to this Example, the front end of the signature 9 is completely guided by the belt 21 in the foregoing manner. Thus, the following effects are obtained: ① The front end of the signature 9 reliably contacts the second jaw cylinder 4 regardless of paper quality. ② The front end of the signature 9 gripped by the first jaw cylinder 3 is reliably raised regardless of paper quality. ③ Jamming between the first jaw cylinder 3 and the second jaw cylinder 4 is resolved.

Furthermore, the front end of the signature 9 is transferred to the second jaw cylinder 4, and then the signature 9 is pressed against the second jaw cylinder 4 by the belt 21. Thus, there is no instability of the trailing edge of the sheet, and a folding trouble (middle fold, corner fold, or cuts in the trailing edge of the sheet) is resolved.

It goes without saying that the present invention is not restricted to the foregoing Example, and various changes may be made unless they depart from the gist of the present invention.

INDUSTRIAL APPLICABILITY

As described above, the parallel folding device of a folding machine according to the present invention is a parallel folding device of a folding machine, comprising a first jaw cylinder and a second jaw cylinder arranged with circumferential surfaces thereof opposed to and in contact with each other, wherein a belt is passed over a part of the circumferential surface of the first jaw cylinder, and the belt can be switched between a guide position at which the belt guides a front end of a signature from the first jaw cylinder to the second jaw cylinder during gripping change from the first jaw cylinder to the second jaw cylinder, and a retreat position to which the belt retreats from the second jaw cylinder when the signature is folded by the first jaw cylinder and the second jaw cylinder. This parallel folding device is capable of parallel double folding and delta folding, and can smoothly and reliably perform transfer of a parallel single-folded signature between the first and second jaw cylinders regardless of paper quality. The parallel folding device is preferred for use in a web rotary press, etc.

What is claimed is:

1. A parallel folding device of a folding machine, comprising:

a first jaw cylinder and a second jaw cylinder arranged with circumferential surfaces thereof opposed to and in contact with each other, said first jaw cylinder being further arranged so as to be opposed to and in contact with an upstream folding cylinder, said first jaw cylinder receiving a signature from said upstream folding cylinder and then transferring the signature to said second jaw cylinder, at least one belt which surrounds said first jaw cylinder and wraps around and contacts a portion of the circumferential surface of the first jaw cylinder, said belt being supported by support means and movable thereby in a travel direction of the signature between a guide position where said belt approaches the circumferential surface of said second jaw cylinder downstream from a point of contact between said first jaw cylinder and said second jaw cylinder, and a retreat position where said belt retreats from the circumferential surface of said second jaw cylinder, said belt, when located at said guide position, guiding a front end of the signature, gripped by a gripping means located on said first jaw cylinder, to said second jaw cylinder, whereby the front end of the signature is subjected to a gripping change from the gripping means on said first jaw cylinder to a gripping means located on said second jaw cylinder, and said belt, when located at said retreat position, allowing the front end of the signature to pass said point of contact while being gripped by said gripping means of said first jaw cylinder and then folded between said first jaw cylinder and said second jaw cylinder.

2. The parallel folding device of a folding machine as claimed in claim 1, wherein said support means comprises:

a plurality of rollers located generally below the first jaw cylinder and adjacent the second jaw cylinder, being rotatably parallel to the first and second jaw cylinder, and wherein the belt is looped between said rollers and the first jaw cylinder.

3. The parallel folding device of a folding machine as claimed in claim 2 wherein a roller of said plurality of rollers closest to the second jaw cylinder is movable toward and away from the second jaw cylinder, whereby the belt is moved between the guide position and the retreat position.

4. The parallel folding device of a folding machine as claimed in claim 1, wherein said at least one belt comprises a plurality of the belts located so as to contact a portion of the circumferential surface of the first jaw cylinder in a region in which the first jaw cylinder transports the signature, and each of the belts traveling in accordance with rotation of the first jaw cylinder by a frictional force working between each of the belts and the circumferential surface of the first jaw cylinder.

5. The parallel folding device of a folding machine as claimed in claim 4, and further comprising:

a plurality of annular grooves formed in the circumferential surface of the first jaw cylinder so as to be out of phase with a gripper board and a folding jaw in a cylinder shaft direction, wherein the belts travel in the annular grooves along the circumferential surface of the first jaw cylinder, and wherein the annular grooves have a depth such that an outer peripheral surface of the belt and the circumferential surface of the cylinder define coplanar peripheral surfaces.

6. The parallel folding device of a folding machine as claimed in claim 1 wherein during said gripping change the belt contacts the front end of the signature and raises a gripping margin of the signature and straightens the front end of the signature as it is guided to the gripping means of said second jaw cylinder.

7. The parallel folding device of a folding machine as claimed in claim 6 wherein the signature is transported by the front end thereof being pinched between gripper means of the first jaw cylinder and when the straightened front end of the signature is raised during the gripping change the belt presses the front end of the signature against the second jaw cylinder where the front end is pinched between gripper means of the second jaw cylinder.

8. The parallel folding device of a folding machine as claimed in claim 7 wherein the gripper means of the first jaw cylinder includes a gripper board and a folding jaw and wherein the gripper means of the second jaw cylinder includes a gripper member and a gripper pad.

9. The parallel folding device of a folding machine as claimed in claim 1 wherein said at least one belt wraps around the first jaw cylinder in the region in which the signature is transported by the first jaw cylinder.

10. A parallel folding device of a folding machine, comprising:

a first jaw cylinder and a second jaw cylinder, each of said cylinders including gripper means, arranged with circumferential surfaces thereof opposed to and in contact with each other, said first jaw cylinder being arranged so as to also be opposed to and in contact with an upstream folding cylinder, said first jaw cylinder receiving a signature from said upstream folding cylinder and then transferring the signature to said second jaw cylinder, at least one movable belt which completely surrounds said first jaw cylinder and wraps around and contacts a portion of the circumferential surface of the first jaw cylinder beneath a signature held and transported thereby, said belt being supported and switched by a roller assembly so as to be movable between a guide position where said belt approaches the circumferential surface of said second jaw cylinder downstream in a travel direction of the signature from a point of contact between said first jaw cylinder and said second jaw cylinder in a first type folding operation, and a retreat position where said belt retreats from the circumferential surface of said second jaw cylinder in a second type folding operation, said belt, when located at said guide position, guiding a front end of the signature gripped by the gripper means of said first jaw cylinder to the gripper means of said second jaw cylinder, whereby the front end of the signature is subjected to a gripping chance from the gripper means of said first jaw cylinder to the gripper means of said second jaw cylinder, wherein during said gripping change from the first jaw cylinder to the second jaw cylinder, the gripper means of said first cylinder releases the front end of the signature, whereupon the belt contacts the front end of the signature and raises a gripping margin of the signature and thereby straightens the front end of the signature as it is guided to and gripped by the gripping means of said second jaw cylinder during said first type folding operation, and wherein said belt, when located at said retreat position, allowing the front end of the signature to pass said point of contact, while being gripped by the gripper means of said first jaw cylinder, the signature is folded between said first jaw cylinder and said second jaw cylinder during said second type folding operation.

11. The parallel folding device of a folding machine as claimed in claim 10 wherein the gripper means the first jaw cylinder includes a gripper board and a folding jaw and wherein the gripper means of the second jaw cylinder includes a gripper member and a gripper pad.

* * * * *